US011117034B2

(12) United States Patent
Chua

(10) Patent No.: US 11,117,034 B2
(45) Date of Patent: Sep. 14, 2021

(54) APPARATUS FOR CONNECTING SHAFT PORTIONS OF SPORTS EQUIPMENT

(71) Applicant: Jaime Tan Chua, Hong Kong (CN)

(72) Inventor: Jaime Tan Chua, Hong Kong (CN)

( * ) Notice: Subject to any disclaimer, the term of this patent is extended or adjusted under 35 U.S.C. 154(b) by 0 days.

(21) Appl. No.: 16/767,475

(22) PCT Filed: Feb. 22, 2019

(86) PCT No.: PCT/IB2019/051449
§ 371 (c)(1),
(2) Date: May 27, 2020

(87) PCT Pub. No.: WO2019/175693
PCT Pub. Date: Sep. 19, 2019

(65) Prior Publication Data

US 2020/0384328 A1 Dec. 10, 2020

(30) Foreign Application Priority Data

Mar. 14, 2018 (HK) ..... 18103571.1

(51) Int. Cl.
*A63B 53/10* (2015.01)
*A63B 53/12* (2015.01)
(Continued)

(52) U.S. Cl.
CPC ..... *A63B 67/148* (2013.01); *A63B 60/16* (2015.10); *A63B 60/28* (2015.10); *A63B 60/52* (2015.10);
(Continued)

(58) Field of Classification Search
CPC ..... A63B 67/148; A63B 60/16; A63B 60/28; A63B 60/52; A63B 2209/02;
(Continued)

(56) References Cited

U.S. PATENT DOCUMENTS 1,634,082 A * 6/1927 Rigby ..... A63B 53/00 473/299
3,516,697 A * 6/1970 Hahn ..... F16B 7/182 403/118
(Continued)

FOREIGN PATENT DOCUMENTS

CN 203506638 U 4/2014
CN 203815399 U 9/2014
(Continued)

*Primary Examiner* — Stephen L Blau
(74) *Attorney, Agent, or Firm* — Muncy, Geissler, Olds & Lowe, P.C.

(57) ABSTRACT

The present invention provides an apparatus for connecting shaft portions of sports equipment comprising a first shaft portion of sports equipment; a second shaft portion of sports equipment; a locking means for mounting the first and second shaft portions; the locking means comprising a locking ring, an extending member and a first receiver means; the extending member mounted to the second shaft portion; the first receiver means comprising a hollow portion adapted for receiving the first portion of the extending member; the first receiver means mounted to the first shaft portion; the locking ring rotatable mounted on the extending member; the extending member comprising a first portion which is removable mounted to the first receiver means; and the first portion adapted for restricting the rotational movement of the extending member inside the first shaft portion.

9 Claims, 5 Drawing Sheets

(51) Int. Cl.
*A63B 67/14* (2006.01)
*A63B 60/16* (2015.01)
*A63B 60/28* (2015.01)
*A63B 60/52* (2015.01)

(52) U.S. Cl.
CPC ..... *A63B 2209/02* (2013.01); *A63B 2210/50* (2013.01)

(58) Field of Classification Search
CPC ..... A63B 2210/50; A63B 60/22; A63B 60/08; A63B 2209/00; B25G 3/30; B25G 1/04; A47L 13/20; A47L 13/42; Y10T 403/32598
See application file for complete search history.

(56) References Cited

U.S. PATENT DOCUMENTS 3,524,646 A * 8/1970 Wheeler ..... A63B 53/007 473/288
3,834,714 A * 9/1974 Smolinski ..... A63B 60/52 473/201
3,848,737 A * 11/1974 Kenon ..... A63B 55/40 206/315.2
6,203,446 B1 * 3/2001 Collins ..... A63B 53/02 473/313
6,547,673 B2 * 4/2003 Roark ..... A63B 60/28 473/239
6,890,269 B2 * 5/2005 Burrows ..... A63B 53/14 473/307
7,226,235 B2 * 6/2007 Conway ..... F16B 7/0406 403/293
7,976,402 B2 * 7/2011 Chol ..... A63B 60/22 473/296
8,328,657 B1 * 12/2012 Demkowski ..... A63B 53/12 473/296
10,471,310 B2 * 11/2019 Brady ..... A63B 53/02
2003/0181255 A1 * 9/2003 Ho ..... A63B 60/00 473/316
2005/0143186 A1 * 6/2005 Blattner ..... A63B 53/14 473/296
2010/0197423 A1 * 8/2010 Thomas ..... A63B 53/02 473/307

FOREIGN PATENT DOCUMENTS

CN 204260693 A 4/2015
CN 204708779 U 10/2015
CN 205411101 U 8/2016
JP 2002039126 A 2/2002

* cited by examiner

APPARATUS FOR CONNECTING SHAFT PORTIONS OF SPORTS EQUIPMENT

TECHNICAL FIELD

The present invention relates broadly to an apparatus for connecting shaft portions of the longitudinal structure or shaft for use in a number of purposes, such as using as a handle of sports equipment and cleaning tools. More specifically, the invention relates to an apparatus for connecting shaft portions of sports equipment.

BACKGROUND OF THE INVENTION

The existing technology of the apparatus for connecting shaft portions of sports equipment is to solve the technical problem of portability. They make use of telescopic shafts that use different diameter shafts where the thinner one slides in and out of the thicker one and both are locked in place by various means. Further, another technology refers to the use of coupler with internal threads where two shafts with threaded ends are screwed into it and held together. Furthermore, another technology refers to the use of externally threaded nipple that holds together two shafts with internally threaded ends.

SUMMARY OF THE INVENTION

The problem to be solved in the present invention is to solve the technical problem of making the sports equipment or other hand tools involving long shaft portion to become portable and easy to carry. Another problem to be solved in the present invention is to solve the technical problem of solving the deformation of sports equipment caused by the unequal torque distribution and/or uneven bending force across the whole shaft of sports equipment after assembly of a plurality of shaft portions of sports equipment. Another problem to be solved in the present invention is to have an apparatus for connecting shaft portions of the handle of sports equipment or hand tool without any form of detraction from the ergonomics of the handle.

The present invention provides an apparatus for connecting shaft portions of sports equipment comprising a first shaft portion of sports equipment; a second shaft portion of sports equipment; a locking means for mounting the said first and second shaft portions; the said locking means comprising a locking ring, an extending member and a first receiver means; the said extending member mounted to the said second shaft portion; the said first receiver means comprising a hollow portion adapted for receiving the said first portion of the said extending member; the said first receiver means mounted to the said first shaft portion; the said locking ring rotatable mounted on the said extending member; the said extending member comprising a first portion which is removable mounted to the said first receiver means; and the said first portion adapted for restricting the rotational movement of the said extending member inside the said first shaft portion.

Typically, the cross-sectional shape of the said first portion of the said extending member is an ellipse-shaped structure.

Typically, the cross-sectional shape of the said first portion of the said extending member is a polygonal-shaped structure.

Typically, the said first receiver means further comprises a threaded member adapted to be received by the said locking ring when it is in a locking position arranged on an end portion of the said first receiver means.

Typically, the said extending member further comprises second and third portions, the said second portion is arranged between the said first and third portions of the said extending member.

Typically, the said third portion of the said extending member is fixedly mounted inside the said second shaft portion.

Typically, the said second portion of the said extending member is of a cylindrical structure.

Typically, the said locking means comprising a locking ring adapted to rotate about the said second portion of the said extending member;

Typically, the said extending member comprises a locking ring positioning member adapted for restricting the movement of the said locking ring from the said second portion of the said extending member to the said first portion of the said extending member, the said locking ring positioning member is arranged between the said first and second portions of the said extending member, the said locking ring positioning member is an extension which is extended outwardly from the outer wall of the said extending member.

Typically, the said second shaft portion comprises a first receiver member for receiving and fixedly mounting the said third portion of the said extending member inside the said second shaft portion, a portion of the said first receiver member is arranged inside the said second shaft portion.

Typically, a ring-shaped structure adapted for rotating about the said second portion of the said extending member and restricting the said locking ring to be moved towards the said second shaft portion is arranged between an end of said second shaft portion and the said locking ring positioning member.

Typically, the said locking ring comprising first and second locking ring apertures arranged on opposing ends of the said locking ring, the diameter of the said second locking ring aperture is smaller than the diameter of the said first locking ring aperture.

Typically, the said extending member is made of nylon.

Typically, the said extending member is made of metal.

Typically, the said extending member is made of carbon-fiber.

Typically, the said extending member is made of a composite material of carbon-fiber and nylon.

Typically, the said extending member further comprises a least one longitudinal element adapted for reinforcement of strength of the said extending member is embedded inside the said extending member.

Typically, a remaining portion of the said first receiver member defines a sliding member adapted for allowing the said locking ring to rotate on the said sliding member and restricting the remaining portion of the said first receiver member to be received inside the said second shaft portion.

Typically, the said sliding member comprises a friction reduction layer adapted for reducing the friction between the said sliding member and the said locking ring when the locking ring is in rotation; the said friction reduction layer is arranged on a face of the said sliding member towards the said second locking ring aperture.

Typically, the said friction reduction layer is a coating of Teflon.

Typically, the said locking means further comprises a movement restricting means adapted for restricting the rotational movement between the said extending member and the said first shaft portion or the said first receiver means, the said movement restricting means comprises at least one longitudinal concave portion arranged on an outer wall of the said first portion of the said extending and at least one convex structure mounted on an inner wall of the said first receiver means or the said first shaft portion.

Typically, the said longitudinal concave portion is an open-ended hole extending along the length of the said first portion, the said convex structure is a longitudinal convex structure mounted along the inner wall of the said first receiver means or a portion of inner wall of the said first shaft portion.

BRIEF DESCRIPTION OF DRAWINGS

This and other objects, features and advantages of the present invention will become apparent upon reading of the following detailed descriptions and drawings, in which.

DESCRIPTION OF EMBODIMENTS

Figure 1:
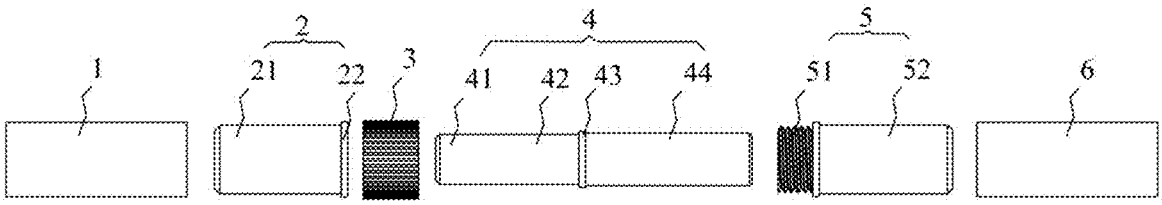
FIG. 1 shows an exploded view of an embodiment of the present invention.

Referring to FIG. 1 to FIG. 8, in an embodiment of the present invention, an apparatus for connecting shaft portions of sports equipment is constructed in the present invention. Typically, a number of sports equipment or hand tools having a long shaft or pole or handle are made for the user to hold by hand(s) in order to perform certain sports activities or cleaning action or other physical activities, such as curling and mopping. The present invention relates to a device that provides for easy connection and disconnection of hollow shafts, whether tubular or rectangular, while preserving the ergonomics of the original shafts. Several types of sporting equipment use long hollow shafts, with a brushing head, a form of blade, or some other implement attached. An important example is the curling broom used in the sport of ice curling. It usually consists of a four foot hollow shaft with a broom head at one end. Because of its long shaft, the curling broom is not convenient to store or transport. This is especially true when a user needs to take it on a public transport such as a train or plane. In most cases transport on planes will also incur a substantial extra baggage fee. The apparatus allows for shorter shafts that can be joined together to be used in place. The shafts can easily be connected into a similar length of the original one piece longer shaft with the apparatus. The apparatus connects a plurality of shorter shafts can perform similarly to the long one piece shaft without detracting from its ability to sustain the typical stresses and multi-axial forces (like bending, pulling, pushing and twisting). After use, the shafts can easily be disconnected and taken apart for convenient transport or storage. Additionally, in the embodiment, the apparatus for connecting shaft portions of the handle of sports equipment or hand tool disallows any form of detraction from the ergonomics of such handle. The thickness or diameter of the apparatus can also be made to approximate the thickness of the shaft, thereby minimizing any visual or ergonomic deviation from the original.

Currently, some equipment, especially those used in sports rely on long hollow shafts that make it inconvenient to transport or store. An example is the curling broom, which usually uses a four foot shaft and is used in the sport of ice curling. The apparatus can make that equipment more portable.

By considering the existing technology of the apparatus for connecting shaft portions of sports equipment, the technical problem is mainly dealing with the portability problem. The deficiencies of using telescopic shafts stated in the preceding paragraphs are that telescopic design is not as suited in handling other stresses aside from the pushing or pulling forces. The telescopic design's need for reducing one shaft in order to allow it to slide into the other weakens its ability to absorb bending forces. Telescopic designs are also not good at sustaining twisting forces. For the use of coupler with internal threads and externally threaded nipple as mentioned above, they are of a structure of threaded end connections of shafts, the above structure actually cannot resist twisting forces. The above structure is made by putting threads on the shafts that lead to weaken the connecting ends of the shafts. The ending of the shafts that emerge from the above structure will be subject to more focused bending forces and cause breakage.

The present invention solves the above problems faced by the existing technology and can handle bending, pushing or pulling forces in addition to twisting forces. Further, the present invention can provide a structure that can be evenly distributed the external bending forces and avoid breakage due to the focused bending forces.

Referring to FIGS. 1, 3, 4, 5, 6 and 7, in the embodiment, it shows the parts and the position of the apparatus in relation to each other and the two shafts it connects. The rod or an extending member 4 fits through the locking ring 3 and is bonded into the sleeve or the first receiver member 2, before that sleeve or the first receiver member 2 (with the assembly) is bonded into shaft A or second shaft portion 1 of the sports equipment. The threaded adaptor or the first receiver means 5 is bonded into shaft B or first shaft portion 6 of the sports equipment. When the proper parts are assembled and bonded, the rod or extending member 4, the locking ring 3 and sleeve or the first receiver member 2 will be attached to shaft A or second shaft portion 1 of the sports equipment and the threaded adaptor or the first receiver means 5 will be attached to shaft B or the first shaft portion 6 of the sports equipment.

In the embodiment, the sports equipment can divide up into a plurality of shafts or shaft portions for the purpose of portability. The sports equipment can be curling broom or hockey stick or other kind of sport equipment having pole or shaft structure. Preferably, the apparatus comprises a first shaft portion 6 of sports equipment, a second shaft portion 1 of sports equipment and an extending member 4 or rod being mounted or bonded to the second shaft portion 1. A locking means is adapted to mount the first and second shafts or poles or shaft portions together. The locking means comprises an extending member 4 or rod, a first receiver means 5 and a locking ring 3. Referring to FIGS. 3, 4, 5 and 6, in order to perform the locking position between the first and second shafts or the first and second shaft portions, the locking means is required to lock the extending member 4, the first receiver means 5 and the locking ring 3 together through screw locking or by other means. Referring to FIGS. 1, 2, 4 and 5, the locking ring 3 is rotatable mounted on the extending member 4 or rod. A first receiver means 5 or the threaded adaptor comprises an aperture having the same shape as that of the cross-sectional shape of the first portion of the extending member 44. Preferably, the first portion of the extending member 44 or rod being configured to be received by a first receiver means 5 of the first shaft portion 6 is adapted for restricting the rotational movement of the extending member 4 or rod inside the first shaft portion 6 mounted to an end portion of the first shaft portion 6. Preferably, the first receiver means comprises the hollow portion for receiving the first portion of the extending member. For the above construction and due to the fact that the first portion of the extending member 44 is not of a cylindrical structure, the first portion cannot be rotated inside the non-circular hollow structure of the first receiver means 5 or the first shaft portion 6 of sports equipment. It prevents any unnecessary or unfavorable twisting motion when the users play the sports activities. The size and shape of the first portion 44 and hollow portion of the first shaft portion 6 or the first receiver means 5 are very close or similar that disallow any unnecessary space or room between the first portion 44 and the first receiver means 5 or the first shaft portion 6. This arrangement prevent any unnecessary vibrational force appeared between the first portion 44 and the first receiver means 5 and along the whole shaft of sports equipment when playing sports.

In the embodiment, referring to FIGS. 1 to 8, the cross-sectional shape of the first portion of the extending member 44 or rod can be of an ellipse-shaped structure or a polygonal-shaped structure. Alternatively, a portion of the first receiver means 5 or the threaded adaptor and the end portion of the first shaft portion 6 are of a unitary structure. Alternatively, the extending member 4 or rod comprises a least one longitudinal element adapted for reinforcement of strength of the extending member 4 or rod is embedded inside the extending member 4 or rod. Alternatively, the longitudinal element is made of metal or carbon fiber. The longitudinal element can also be mounted on the surface of the extending member 4.

Figure 8:
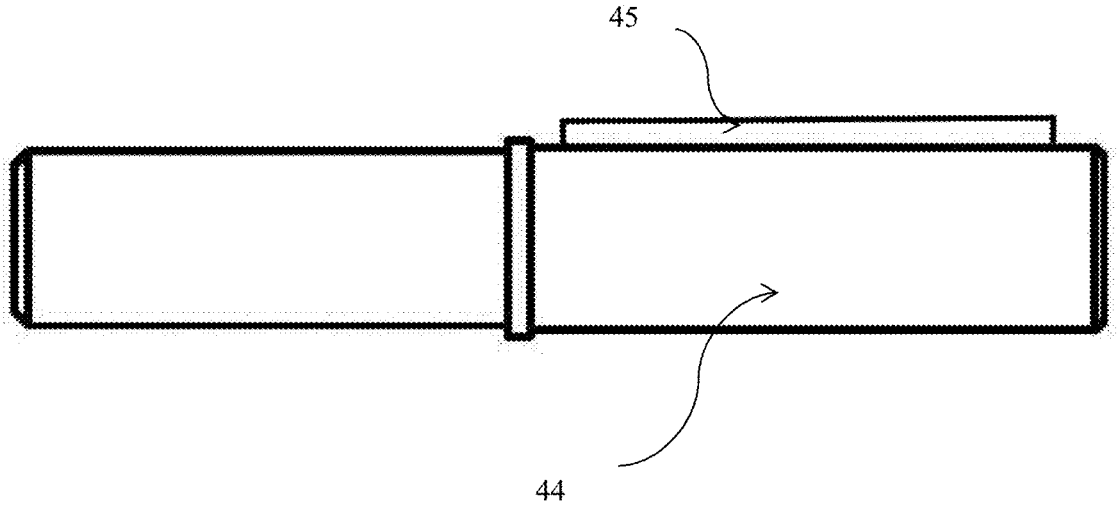
FIG. 8 shows a front view of the longitudinal structure of the first portion of another embodiment of the present invention.

Alternatively, referring to FIG. 8, the first portion can be of cylindrical structure with a longitudinal structure 45 on a key channel mounted on its surface. Such longitudinal structure 45 or key channel can be received by a concave region which is arranged on the hollow portion and the first receiver means. It is used to restrict the rotational motion of the first portion by locking the longitudinal structure 45 inside the concave region of the first receiver means.

Figure 2:
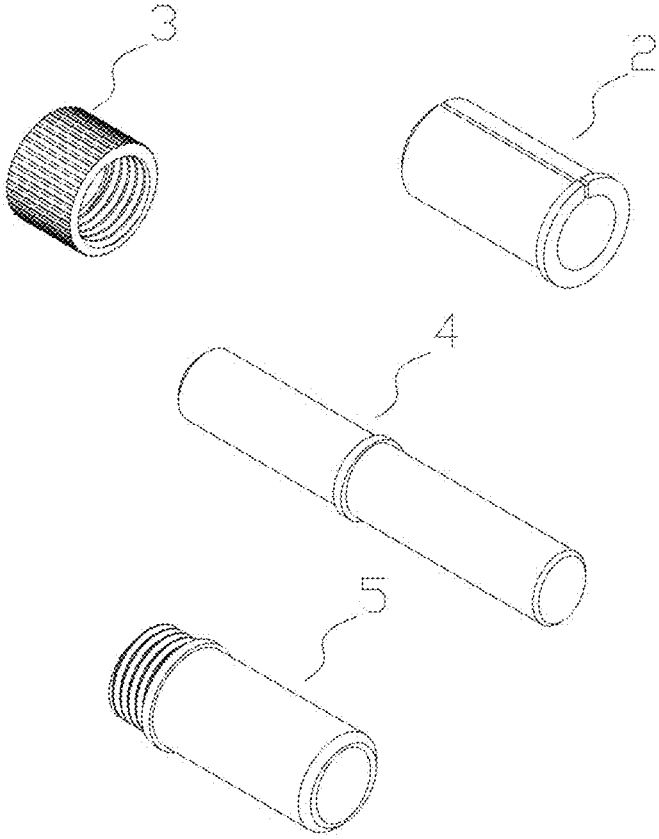
FIG. 2 shows perspective views of a locking ring, an extending member, a first receiver member and a first receiver means of the embodiment of the present invention.

Preferably, referring to FIGS. 1 and 2, the first receiver means 5 or the threaded adaptor has a threaded member 51 adapted to be received by the locking ring 3 when it is in a locking position arranged on an end portion of the first receiver means 5 or the threaded adaptor. Particularly, the first 6 and second 1 shaft portions can be mounted with each other through a screw-locked structure of the locking means.

In the embodiment, referring to FIGS. 1 to 8, the extending member 4 or rod has a second portion 42. Alternatively, the extending member 4 or rod also has a third portion 41. The second portion of the extending member is arranged between the first 44 and third portions 41 of the extending member or rod. Alternatively, the third portion of the extending member 41 or rod is fixedly mounted or bonded inside the second shaft portion 1 of sports equipment. Typically, the second portion of the extending member 42 or rod is of a cylindrical structure. Therefore, the locking ring 3 of the locking means can be rotated about the second portion of the extending member 42 or rod.

In the embodiment, referring to FIGS. 1 and 2, the extending member 4 or rod comprises a locking ring positioning member 43 which is used for restricting the movement of the locking ring 3 from the second portion of the extending member 42 or rod to the first portion of the extending member 44. Typically, the locking ring positioning member 43 is an extension which is extended outwardly from the outer wall of the said extending member. Alternatively, the locking ring positioning member 43 is a ring-shaped structure arranged on the outer surface of the extending member 4 or rod. The locking ring positioning member 43 is preferably arranged between the first portion 44 and second portion 42 of the extending member or rod.

In the embodiment, the second shaft portion 1 comprises a first receiver member 2 or sleeve adapted for receiving and fixedly mounting the third portion of the extending member 41 or rod inside the second shaft portion 1 of sports equipment, a portion of the first receiver member 2 or sleeve is arranged inside the second shaft portion 1. Alternatively, a portion of the first receiver member 2 is attached to the second shaft portion 1. Alternatively, a portion of the first receiver member 2 and the end portion of the second shaft portion 1 are of a unitary structure.

Preferably, referring FIGS. 1 and 2, the remaining portion of the first receiver member 21 or sleeve defines or forms a sliding member 22. The sliding member 22 can be a ring-shaped surface arranged on the end of the sleeve or end of the second shaft portion 1. The sliding member 22 can be a smooth ring-shaped surface or frictionless surface which allows the locking ring 3 to rotate on it smoothly and holds locking ring 3 in place when rotation. Due to the fact that the aperture of the sliding member 22 is greater than the diameter of the end of the second shaft portion 1 such that the sliding member 22 can restrict the remaining portion of the first receiver member 21 or sleeve to be received inside the second shaft portion 1. Alternatively, the sliding member 22 comprises a friction reduction layer adapted for reducing the friction between the sliding member 22 and the locking ring 3 when the locking ring is in rotation, the friction reduction layer is arranged on a face of the sliding member 22 towards the second locking ring aperture. Alternatively, the friction reduction layer is a coating of Teflon.

Referring to FIGS. 1, 3, 4, 5 and 6, it shows the four components that constitute the apparatus—the sleeve or the first receiver member (optional) 2, locking ring 3, rod or extending member 4, and threaded Adaptor or the first receiver means 5. Parts of the apparatus can be made from a plastic such as nylon, or metal, or composites or any combination of the three (such as carbon-fiber reinforced nylon, etc.). It is possible to have one or more parts made from the same or different materials from the rest in order to optimize on the strength and lightness of the each part.

For the part of sleeve or the first receiver member 2, this part, depending on the shape of the hollow shaft it will fit into, can have a round or polygonal external shape. The sleeve or the first receiver member 2 has a ridge at one end as a stop for mounting into the shaft and as a sliding surface for the locking ring 3. The internal shape and size of the sleeve or the first receiver member 2 are those that allow insertion of the 'left' side of the rod or the extending member 4. The part can be optional if it is unnecessary to keep the locking ring 3 diameters flush with the shafts. In such a case, the rod or extending member 4 is inserted through the locking ring 3, a spacer and then inserted and bonded directly into the shaft A or the second shaft portion 1 of the sports equipment. When fitted, the sleeve or the first receiver member 2 adapts the rod or the extending member 4, with the attached locking ring assembly or locking means to the shaft A or the second shaft portion 1 of the sports equipment.

Further, in the embodiment, referring FIG. 2, regarding the part of locking ring 3, this part can be round and open at both ends to allow the rod or extending member 4 to pass through. It has some texture on the exterior to reduce slippage, is threaded most of the way internally and has an internal ridge at the end facing the shaft to catch the ridge on the rod or the extending member 4. The ridge end's outward facing surface or a surface surrounding the second locking ring aperture may be coated with Teflon or paired with a thin Teflon coated spacer to reduce friction with the sleeve or first receiver member's ridge 2 or the sliding member 22. Preferably, the sliding member 22 or sleeve can also be coated with Teflon. Friction occurs as the locking ring 3 pushes back against the sleeve or the first receiver member 2 to pull the rod or extending member 4 out of the threaded adaptor or the first receiver means 5 or the first shaft portion 6, unlock the apparatus and disconnect the shafts including the first 6 and second 1 shaft portion. The locking means serves to secure the two shafts, such as first and second shaft portions, together by locking the rod or the extending member 4 to the threaded Adaptor or first receiver means 5, at the same time permitting easy disassembly. It counters pulling forces on the joined shafts and reinforces the rod or extending member 4 against bending stresses when the locking means is in a locking position.

Further, in the embodiment, referring to FIGS. 1, 2 and 8, regarding the rod or the extending member 4, this part is a solid shaft that has three distinct areas. It is described by looking at it horizontally from 'left' to 'right'. The 'left' part or the third portion of the extending member 41 is usually cylindrical with a diameter and length designed to fit into the sleeve or the first receiver member 2. Alternatively, the cross-section of the third portion can be of a polygonal shape. Preferably, the second portion of the extending member 42 or the rod is constructed as a cylindrical structure for allowing the locking ring 3 be rotated about it. In the embodiment, the second portion 42 is arranged between the first portion 44 and third portion 41. Alternatively, the third portion 41 and second portion 42 can be of a unitary body which is of a cylindrical structure. Further, this is followed in the middle by a raised ridge or the locking ring positioning member 43 designed to catch the end of the locking ring 3. The 'right' portion or the first portion of the extending member 44 can be long and non-cylindrical in shape. In particular, the cross-section of the first portion 44 can be of an ellipse shape or polygonal shape. Length of each side of the rod or the extending member 4 is determined by the need to distribute bending forces at the ends of the shafts including the first 6 and second 1 shaft portions. In the embodiment, the rod or extending member's 4 functions are to acts as the removable member of the apparatus, provides a continuation of the load bearing capability going from shaft A or the second shaft portion 1 of the sports equipment to shaft B or the first shaft portion 6 of the sports equipment, distributes bending forces on the apparatus and the ends of the two connected shafts including the first 6 and second 1 shaft portions, resists twisting forces with a non-cylindrical shape, when inserted into the threaded adaptor, the first receiver means 5 and the first shaft portion 6 and provides a 'catch' for the locking ring 3.

Preferably, the cross-section of the left' segment or the third portion of the rod or extending member 41 can be of cylindrical or polygonal shape if used with the sleeve or the first receiver member 2. This part fits through the locking ring 3 and is inserted and bonded into the sleeve or the first receiver member 2. If the sleeve or the first receiver member 2 is not used, this part should be shaped like that of the shaft it will be attached to, until just before the middle ridge or the locking ring positioning member 43 where it turns round to accommodate the locking ring 3 and allow that to rotate about the second portion of the extending member 42 or rod. When the 'left' segment or third portion 41 or second portion 42 of the extending member or rod is inserted through the locking ring 3 into the sleeve or the first receiver member 2 or directly into a shaft, enough clearance should left to allow the locking ring to turn freely.

Preferably, the middle segment of the rod or the extending member 4 is a raised ridge that serves as a 'catch' to retain the locking ring 3 as it locks shaft A or the second shaft portion 1 and shaft B or the first shaft portion 6.

Preferably, the "right" segment or the first portion of the rod or the extending member 44 is the portion that permits the apparatus to connect and disconnect easily. It is not bonded or mounted to any other part and allows it to be inserted and removed from the threaded adaptor or the first receiver means 5 or the first shaft portion 6 easily. This portion can be ellipse, polygonal, round with key channel or any other shape that can counter turning and twisting forces.

In the embodiment, referring to FIGS. 1, 2, 3, and 7, regarding the part "the threaded adaptor" or the first receiver means 5, this part consists of a threaded round segment or the threaded member, followed by a raised ridge and a round or rectangular shaped portion that conforms with the shape of the first shaft portion 6 and is inserted and bonded into the first shaft portion 6. The raised ridge stops the threaded portion or thread member of the first receiver means 5 from being inserted into the first shaft portion 6. The threaded adaptor or the first receiver means 5 internal shape conforms with the 'right' side or the first portion of the rod or the extending member 44 and allows that part of the rod or the extending member 4 to slide in and out for assembly and disassembly. The locking ring 3 (with the rod or extending member 4 and shaft A or the second shaft portion 1 of the sports equipment assembly) screws onto the threaded Adaptor or first receiver means 5 to form a tight fit and hold the apparatus and the two shafts including the first 6 and second 1 shaft portions together. The rod or the extending member 4 should fit snugly into the threaded adaptor or the first receiver means with the locking ring 3 holding the rod or the extending member tightly to the threaded adaptor or the first receiver means 5 or the first shaft portion 6 (with shaft attached).

Figure 3:
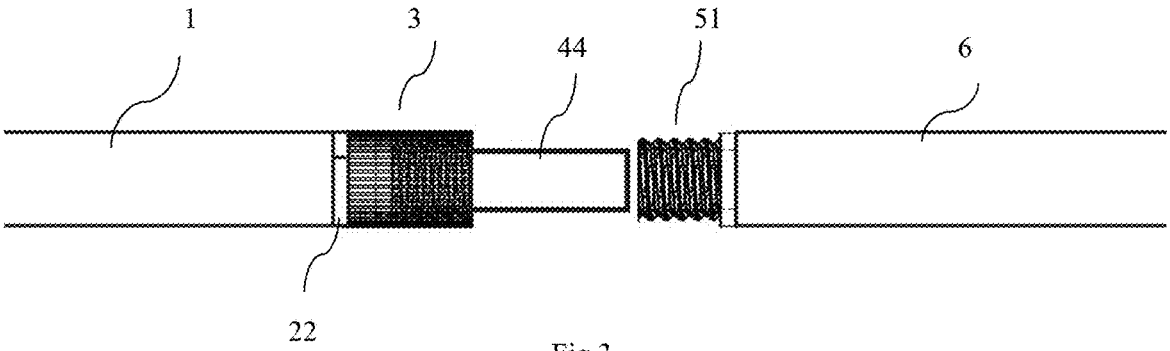
FIG. 3 shows a first assembly view of the extending member, the locking means, the first receiver member and the second shaft portion of the embodiment of the present invention.

Referring to FIG. 3, it shows how the two shafts including the first shaft portion 6 and second shaft portion 1 with the appropriate parts of the apparatus attached and not locked together. The image of shaft A or the second shaft portion 1 of the sports equipment shows the shaft with the locking ring 3 and the protruding part of the 'right' end or the first portion of the Rod or extending member 44 showing. The image of Shaft B or the first shaft portion 6 of the sports equipment shows it with the threaded part of the threaded adaptor or the first receiver means 5 showing.

FIG. 3 further shows the two shafts including the first 6 and second 1 shaft portions joined together by the apparatus and how it looks. The two joined shafts will only be slightly longer than the original long single shaft. The difference in length and external look is just the presence of the locking ring 3.

Figure 4:
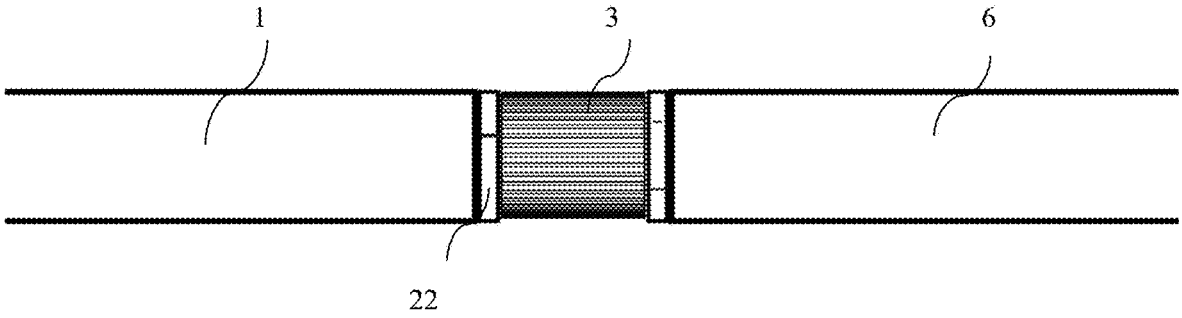
FIG. 4 shows a second assembly view of the embodiment of the present invention.
Figure 5:
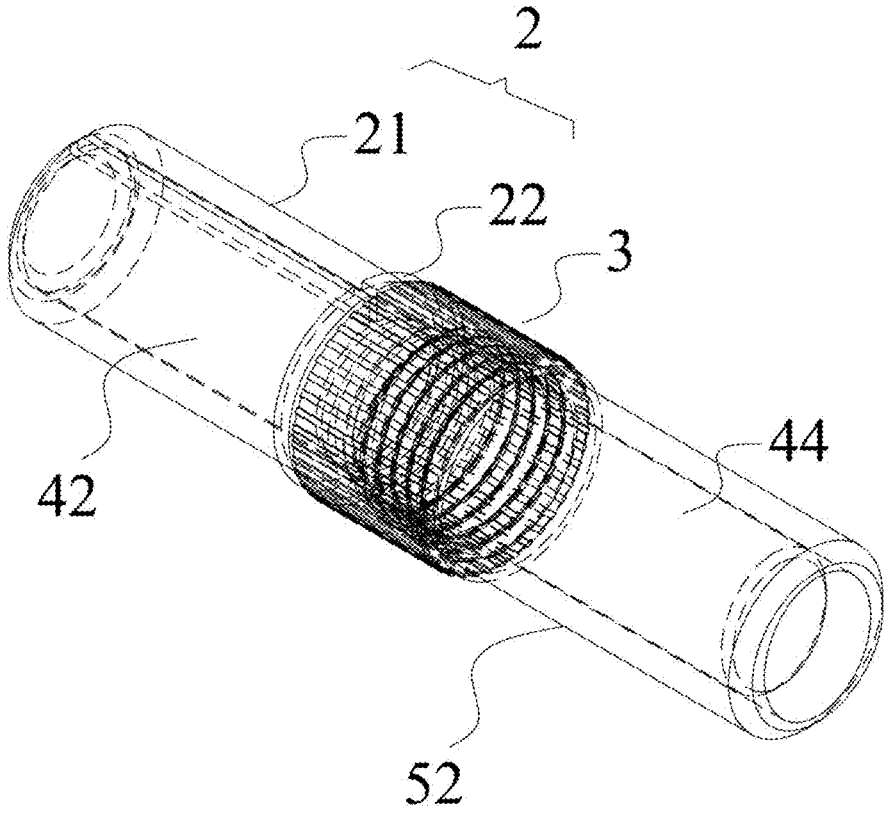
FIG. 5 shows a first perspective view of the embodiment of the present invention.
Figure 6:
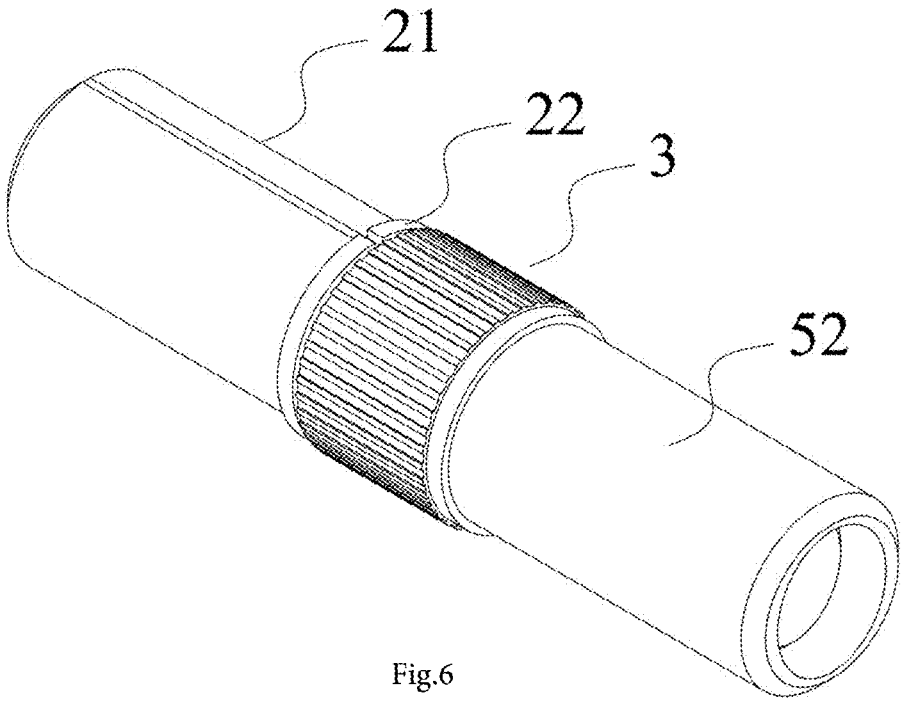
FIG. 6 shows a second perspective view of the embodiment of the present invention.
Figure 7:
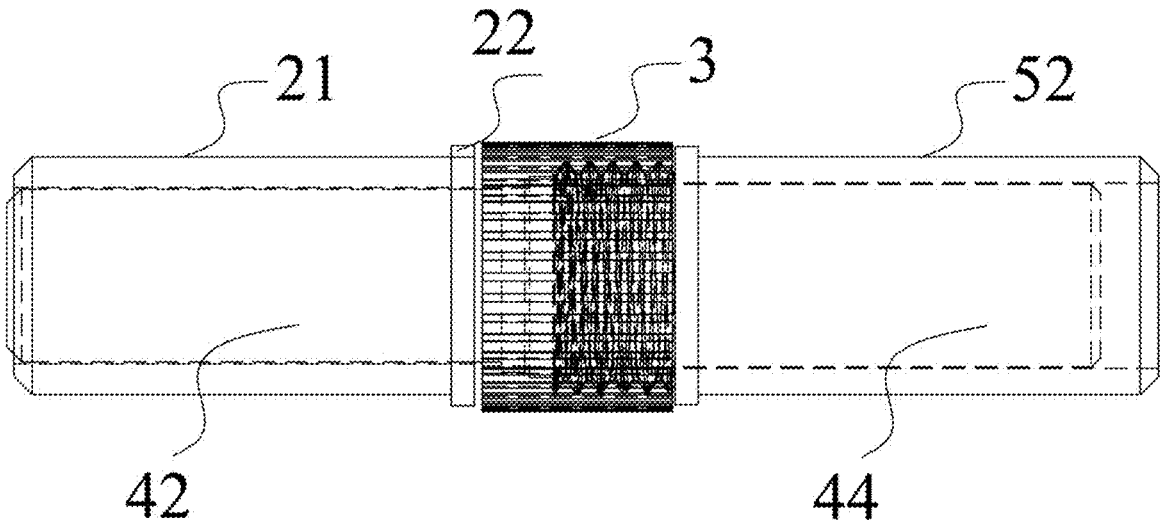
FIG. 7 shows a front view of the embodiment of the present invention.

Referring to FIG. 4, it shows the apparatus assembly locked without the hollow shafts it connects. It is shown from different angles.

Alternatively, the locking ring 3 comprises first and second locking ring apertures which are arranged on opposing ends of the locking ring, the diameter of the second locking ring aperture is smaller than the diameter of the first locking ring aperture. As such, the first locking ring aperture can pass through the locking ring positioning member 43 but the second locking ring aperture cannot pass through. In particular, for locking purpose, the cross-sectional diameter of the locking ring positioning member 43 is preferably greater than the diameter of the second locking ring aperture.

In the embodiment, the extending member 4 or rod can be made of plastic, such as nylon. Alternatively, it can also be made of metal or carbon-fiber or a composite material of carbon-fiber and nylon.

In another embodiment, a first receiver member or sleeve will not be constructed in the present invention. Preferably, a ring-shaped structure or a structure having an aperture in its center portion is arranged between an end of the second shaft portion 1 and the locking ring positioning member 43. The above ring-shaped structure is adapted to be rotated about the second portion of the extending member 42 and restrict the locking ring 3 to be moved towards the second shaft portion 1 is arranged between an end of the second shaft portion 1 and the locking ring positioning member 43.

Figure 9:
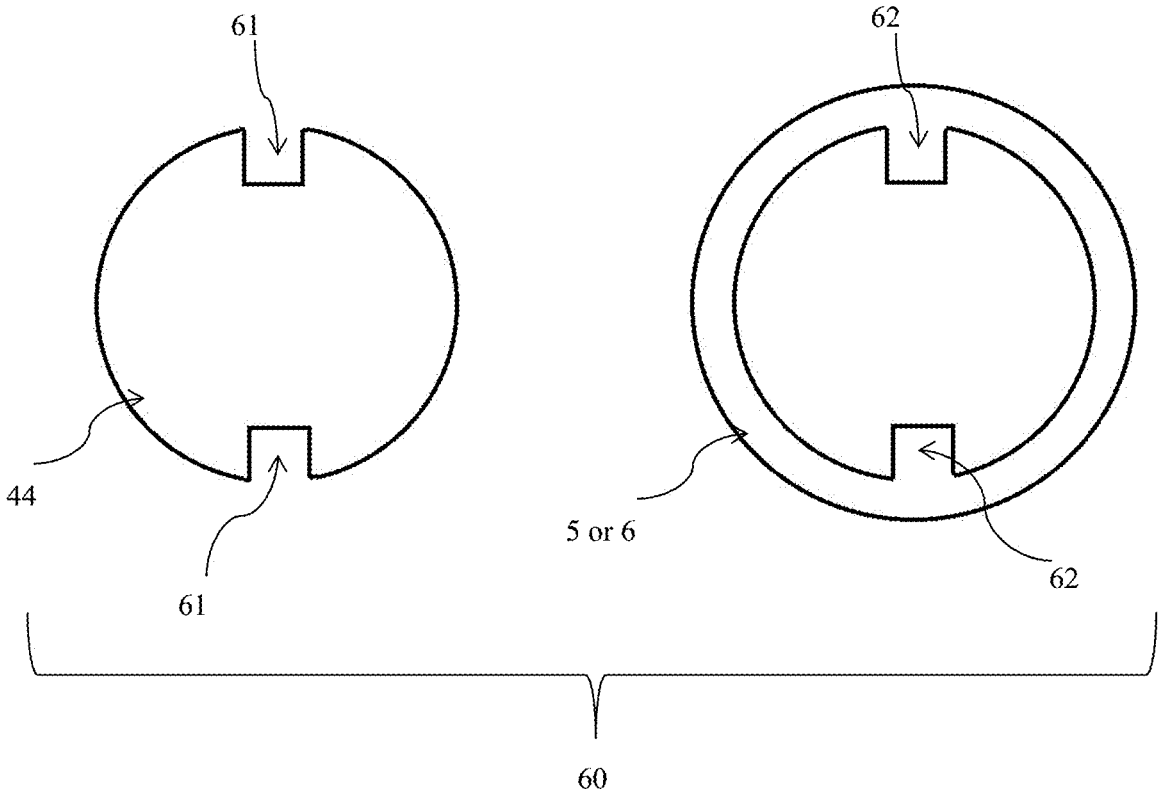
FIG. 9 shows cross-sectional views of longitudinal concave portions and convex structures of the movement restricting means of another embodiment of the present invention.

In another embodiment, referring to FIG. 9, the locking means further comprises a movement restricting means 60 adapted for restricting the rotational movement between the extending member 4 and the first shaft portion 6 or the first receiver means 5. The movement restricting means 60 can comprise at least one longitudinal concave portion 61 arranged on an outer wall of the first portion 44 and at least one convex structure 62 mounted on an inner wall of the first receiver means 5 or the first shaft portion 6. In this embodiment, the at least one longitudinal concave portion is configured for receiving the at least one convex structure 62 of the first receiver means 5 or the first shaft portion 6. Preferably, the number of the at least one convex structure 62 of the first receiver means 5 or the first shaft portion 6 is less than or same as the number of the at least one longitudinal concave portion 51. When the at least one convex structure is received inside the at least one longitudinal concave portion 61, a portion of the extending member 4 will be locked inside the first receiver means 5 or the first shaft portion 6. Due to the fact that the convex structure is received inside the longitudinal concave portion 61 and the dimensions of the convex structure 62 is slightly smaller than or the same with the longitudinal concave portion 61, the direction of motion of the convex structure 62 inside the longitudinal concave portion 61 is limited and/or restricted with exception of the line of motion along the extending member 4 and the first shaft portion 6. In this embodiment, the first portion 44 of the extending member 4 can be of cylindrical structure. Preferably, a portion of the first portion 44 can be received by the locking ring 3. As such, the diameter of the first portion 44 is smaller than or same as the diameter of an inner aperture of the locking ring 3. Specifically, the locking ring 3 is allowed to be rotated about the first portion 44. Alternatively, the first portion 44 can be of a hollow structure and can be made of a material containing carbon fiber. Alternatively, the at least one longitudinal concave portion 61 can be an open-ended hole extending along the length of the first portion 44. Alternatively, the at least one convex structure 62 can be a longitudinal convex structure 62 mounted along the inner wall of the first receiver means 5 or along a portion of inner wall of the first shaft portion 6.

The present invention has been described in detail, with reference to the preferred embodiment, in order to enable the reader to practice the invention without undue experimentation. However, a person having ordinary skill in the art will readily recognizes that many of the previous disclosures may be varied or modified somewhat without departing from the spirit and scope of the invention. Accordingly, the intellectual property rights to this invention are defined only by the following claims.

I claim:

1. An apparatus for connecting shaft portions of sports equipment comprising:

a first shaft portion of sports equipment;

a second shaft portion of sports equipment;

a locking means for mounting said first and second shaft portions;

said locking means comprising a locking ring, an extending member and a first receiver means;

said extending member mounted to said second shaft portion;

said first receiver means comprising a hollow portion adapted for receiving a first portion of said extending member;

said first receiver means mounted to said first shaft portion;

said locking ring rotatably mounted on said extending member;

said first portion of said extending member being removably mounted to said first receiver means; and said first portion of said extending member being adapted for restricting the rotational movement of said extending member inside said first shaft portion, wherein the cross-sectional shape of said first portion of said extending member is an ellipse-shaped structure, wherein said first receiver means comprises an aperture having the same shape as that of the cross-sectional shape of said first portion of said extending member, wherein said first receiver means further comprises a threaded member adapted to be received by said locking ring when it is in a locking position arranged on an end portion of said first receiver means, wherein said extending member further comprises second and third portions, said second portion is arranged between said first and third portions of said extending member, wherein said third portion of said extending member is fixedly mounted inside said second shaft portion, wherein said locking ring is adapted to rotate about said second portion of said extending member, wherein said extending member comprises a locking ring positioning member adapted for restricting the movement of said locking ring from said second portion of said extending member to said first portion of said extending member, said locking ring positioning member is arranged between said first and second portions of said extending member, said locking ring positioning member is an extension which is extended outwardly from the outer wall of said extending member, and wherein said second shaft portion comprises a first receiver member for receiving and fixedly mounting said third portion of said extending member inside said second shaft portion, a portion of said first receiver member is arranged inside said second shaft portion, a remaining portion of said first receiver member defines a sliding member adapted for allowing said locking ring to rotate on said sliding member and restricting the remaining portion of said first receiver member to be received inside said second shaft portion.

2. The apparatus for connecting shaft portions of sports equipment according to claim 1, wherein said first portion of said extending member comprises a first portion longitudinal structure mounted on said first portion.

3. The apparatus for connecting shaft portions of sports equipment according to claim 2, wherein said hollow portion of said first receiver means comprises a concave region being arranged on the inner wall of said hollow portion adapted for receiving said first portion longitudinal structure of said first portion.

4. The apparatus for connecting shaft portions of sports equipment according to claim 1, wherein said second portion of said extending member is of a cylindrical structure.

5. The apparatus for connecting shaft portions of sports equipment according to claim 1, wherein said locking ring comprising first and second locking ring apertures arranged on opposing ends of said locking ring, the diameter of said second locking ring aperture is smaller than the diameter of said first locking ring aperture.

6. The apparatus for connecting shaft portions of sports equipment according to claim 5, wherein said sliding member comprises a friction reduction layer adapted for reducing the friction between said sliding member and said locking ring when the locking ring is in rotation, said friction reduction layer is arranged on a face of said sliding member towards said second locking ring aperture.

7. The apparatus for connecting shaft portions of sports equipment according to claim 6, wherein said friction reduction layer is a coating of Teflon.

8. The apparatus for connecting shaft portions of sports equipment according to claim 1, wherein said extending member is made of a material containing nylon, carbon-fiber or metal.

9. The apparatus for connecting shaft portions of sports equipment according to claim 1, wherein said locking means further comprises a movement restricting means adapted for restricting the rotational movement between said extending member and said first shaft portion or said first receiver means, said movement restricting means comprises at least one longitudinal concave portion arranged on an outer wall of said first portion of said extending member and at least one convex structure mounted on an inner wall of said first receiver means or said first shaft portion, said longitudinal concave portion is an open-ended hole extending along the length of said first portion, said convex structure is a longitudinal convex structure mounted along the inner wall of said first receiver means or a portion of inner wall of said first shaft portion.

* * * * *